United States Patent [19]

Saito et al.

[11] Patent Number: 4,522,525

[45] Date of Patent: Jun. 11, 1985

[54] WRITING INSTRUMENT HAVING A NEEDLE SLIDABLY MOUNTED IN A TUBULAR TIP

[75] Inventors: Sigeru Saito, Kasuga; Takahiko Shimizu, Tokyo; Takasi Tamura, Soka, all of Japan

[73] Assignee: Pentel Kabushiki Kaisha, Tokyo, Japan

[21] Appl. No.: 507,226

[22] Filed: Jun. 23, 1983

[30] Foreign Application Priority Data

Aug. 3, 1982 [JP] Japan ..... 57-118219[U]

[51] Int. Cl.[3] ..... B43K 1/06; B43K 5/16; B43K 1/10

[52] U.S. Cl. ..... 401/258; 401/259

[58] Field of Search ..... 401/258, 259, 260

[56] References Cited

U.S. PATENT DOCUMENTS

| | | | |
|---|---|---|---|
| 243,364 | 6/1881 | Downes | 401/260 |
| 2,029,152 | 1/1936 | Bonkowski . | |
| 3,459,486 | 8/1969 | Matschkal | 401/259 |
| 3,561,881 | 2/1971 | Bok | 401/258 |
| 3,580,689 | 5/1971 | Riepe | 401/258 |
| 3,938,899 | 2/1976 | Mutschler | 401/260 |
| 4,364,684 | 12/1982 | Kohno et al. . | |

FOREIGN PATENT DOCUMENTS

| | | | |
|---|---|---|---|
| 1561871 | 4/1970 | Fed. Rep. of Germany | 401/259 |
| 430339 | 2/1948 | Italy | 401/259 |
| 867 | of 1880 | United Kingdom | 401/260 |

*Primary Examiner*—Steven A. Bratlie

*Attorney, Agent, or Firm*—Wenderoth, Lind & Ponack

[57] ABSTRACT

A writing instrument has a tubular tip and a needle longitudinally mounted within the tubular tip for enhancing the flow of ink towards a writing point of the tubular tip. The writing instrument has a mechanism which provides a smooth flow of ink without forming an air ring or bubble in the passage of the ink.

11 Claims, 12 Drawing Figures

WRITING INSTRUMENT HAVING A NEEDLE SLIDABLY MOUNTED IN A TUBULAR TIP

BACKGROUND OF THE INVENTION

The present invention relates to a writing instrument of the type having a tubular writing tip and a needle longitudinally movably mounted within the tubular writing tip, and more particularly to such an instrument further comprising a weight or an inertia member connected to the displaceable needle so as to enhance the longitudinal movement of the needle for the principal purpose of ensuring a continuous and smooth capillary action of ink from an ink reservoir towards the tubular writing tip.

In a conventional writing instrument of the type described, an ink feeding action or capillary action towards the writing tip is enhanced by providing a longitudinally movable needle as described above, or by providing an ink carrier or a supplemental ink holder between the tubular writing tip and the ink reservoir.

In case of the movable needle, the longitudinal movement of the needle for enhancing the ink capillary action has been effected either by providing a longitudinal weight member at the rear end of the needle so that movement of the needle is enhanced by the inertia of the weight member, or by providing a resilient seat, such as an ink permeable resilient member as described in U.S. Pat. No. 4,364,684 assigned to the present assignee, or a spiral spring as suggested in U.S. Pat. No. 2,029,152. The movable needle functions to clean any foreign materials which block the tubular writing tip and also to provide a desirable capillary action in an annular space defined between the tubular writing tip and the surface of the needle.

In case of the supplemental ink carrier provided between the ink reservoir and the writing tip, the ink carrier carries an excessive ink temporarily so as to prevent ink from dropping from the writing tip, such ink drop generally being due to some change in the ink reservoir as a result of a change of atmospheric pressure and/or temperature, and to provide a continuous, smooth flow of ink to the writing tip to avoid any obstruction of ink flow or shortage of ink at the writing tip.

The needle and/or supplemental ink carrier are advantageous mechanisms, but they do not always work as well as expected and sometimes fail to work effectively. The inventors of the present invention consider that one of the reasons for failure of the expected function is that an air ring or bubble is retained at portions in the ink channel, particularly at a position adjacent the front end of the ink reservoir, adjacent a stopper element for limiting a backward movement of the weight element. Another reason is that the supplemental ink carrier, when used as an ink feed between a cylindrical tip holder, which is mounted on a casing of the instrument and longitudinally slidably holds therein the needle, and the ink reservoir, is deformed, though very slightly, during the step of assembly. This is especially true when the ink carrier is of the type having a number of annular small recesses to form a bellows-like structure.

SUMMARY OF THE INVENTION

An object of the present invention is to provide an improved writing instrument which provides a smooth ink/air exchange within the instrument so as to establish a desired ink feeding action.

Another object of the present invention is to provide a new writing instrument which can avoid the formation of an air ring or bubble within the casing of the instrument, for example at positions adjacent to a rear end and/or a front end of a weight member connected to a slidable needle.

A further object of the present invention is to provide a new structure which does not provide torsion of an ink feed located between a cylindrical tip holder and the ink reservoir.

Another object of the present invention is to provide an improved writing instrument in which the needle can be assembled with ease without damage or breakage of the needle.

In the present invention, a smooth ink/air exchange is obtained by providing a stopper device on an inner surface of the casing at a position adjacent the rear end of the weight element for limiting rearward movement of the weight, and an ink feed passage at a position adjacent the stopper device. By the arrangement of the stopper and ink feed passage, ink in the reservoir is continuously fed through the ink feed passage when air is introduced into the casing from the tip of the writing instrument as ink is consumed during writing, and even if the air is retained adjacent the stopper device. Accordingly, the air introduced into the casing in not retained at the passage-way of ink, but is positively fed into the ink reservoir, and ink is fed without obstruction due to the air ring or bubble.

In another embodiment of the invention, the longitudinal weight member, which preferably is formed as a tubular structure, has a first tapered portion which confronts a portion of an inner wall of the cylindrical tip holder to form a relatively small space. If desired, the first tapered portion may be formed such that it entirely contacts the surface portion of the inner wall of the tip holder so that no space is formed between the first tapered portion and the corresponding portion of the wall of the tip holder when the needle/weight structure is located at its frontmost position proximal to the writing tip. The weight member has a second tapered portion which confronts the other portion of the inner wall so that a relatively large space is formed between the second tapered portion and the other portion of the inner wall. The smaller space, when formed, is thicker in cross section at its rear end than at its front end to have a wedge-like configuration. By the combination of two spaces, a stronger capillary area and a weaker capillary area are formed at the position of the front end of the weight member, the front end being connected to the needle. The stronger capillary area provides a desired ink feeding effect and, on the other hand, the provision of the weaker capillary area is effective to decrease excessive air suction action which conventionally is induced by a rearward movement of the weight member. If only a stronger capillary area is formed, excessive air is positively introduced into the casing to form an air ring or bubble which blocks the flow in ink. Accordingly, in the present invention, such an objectionable pumping or suction action of air is minimized. When air is once introduced into the ink passage from the writing tip, the air is fed rearwardly into the ink reservoir through the weaker action area, and accordingly a desired ink feeding rate is not disturbed.

In another embodiment of the invention, a bellows-like ink feed or carrier is provided in a press-fit connection between the tip holder and the ink reservoir. The ink feed has a number of annular grooves for temporarily retaining ink for the purpose of avoiding an excessive ink flow towards the writing tip and, at the same time, supplying ink in a smooth manner to the writing tip. The ink feed is connected at its front end by a press fit with the tip holder. The rear end of the ink feed is press fit to a portion of the casing which extends radially inwardly to form an abutment. Connection of these elements may be made in other desired methods. For example, the ink feed can be rigidly connected to the tip holder while it is slightly or loosely contacted with the aforesaid abutment of the casing, and vice versa, so that parts of the device may be readily replaced.

In another embodiment of the invention, a needle is inserted into a tubular weight member, and both elements are connected together at adjacent ends thereof so that the needle projects from the tubular weight member with a desired flexibility relative to an axis of the tubular weight member. This arrangement can provide flexibility to the needle and therefore prevent the needle, particularly during assembly, from being broken or damaged.

Additional objects and features of the present invention will become apparent from the following detailed description of preferred embodiments which will be made with reference to the accompanying drawings.

DETAILED DESCRIPTION OF PREFERRED EMBODIMENTS

Figure 1:
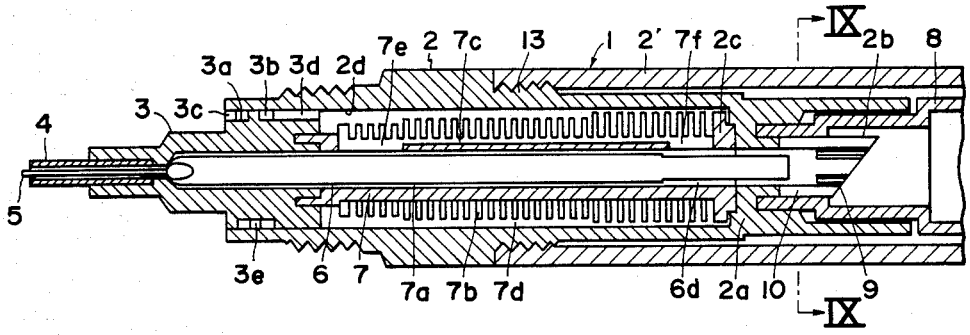
FIG. 1 is a longitudinal sectional view of a writing instrument embodying the present invention.
Figure 2:
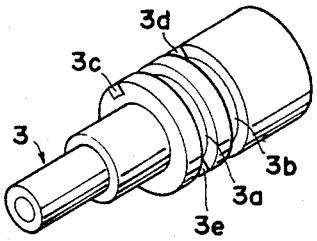
FIG. 2 is an enlarged perspective view of a tip holder mounted to a front end of a casing.

Referring to FIGS. 1 and 2, a barrel or tubular casing 1 consists of a front casing 2 and a rear casing 2' removably connected to the front casing 2 at a thread 13. The front casing 2 extends further rearwardly from the thread 13 along and within the rear casing 2'. A radially inwardly extended abutment portion *2a* is formed on the extended portion of the front casing 2 so that an ink feed, which will be described in detail presently, is in a facewise abutment or a press-fit connection with the abutment portion *2a*. To the front casing 2 is snugly disposed a tip holder 3 which has spaced annular grooves *3a* and *3b* around the outer surface thereof and longitudinal grooves *3c*, *3d* and *3e*, each extending in the axial, longitudinal direction of the instrument to thereby form an air passage leading to the outside of the casing. The tip holder 3 is cylindrical and has a tubular writing tip 4 projecting outwardly and coaxially. A needle 5 is longitudinally slidably mounted within the tubular tip, and projects slightly from an outer end of the tip 4 in a non-use state of the writing instrument, but can be depressed into the holder 3 to be flush with the outer end of the tip 4 when writing pressure is applied to the writing tip. Preferably, the tubular tip 4 has at a front end portion thereof a hardwearing layer or a projection made of a hard material such as, for example, a ceramic. The needle 5 has a longitudinal weight 6 connected together in an alignment relation so that the unitary structure of needle and weight is slidable in the longitudinal direction. The weight 6 extends through a hole *7a* of an ink feed 7 towards the abutment *2a* of the front casing 2. The ink feed 7 has a plurality of annular grooves *7b* for carrying ink, an axial ink passage *7c*, an air passage *7d*, and ports *7e*, *7f* which connect the hole *7a* to the ink passage *7c*. In the embodiment illustrated in FIG. 1, the weight member 6 is thinner at its rear end portion *6d* for the purpose of enhancing air displacement from the writing tip towards an ink reservoir 8, which is provided at the rear portion of the writing instrument.

Figure 3:
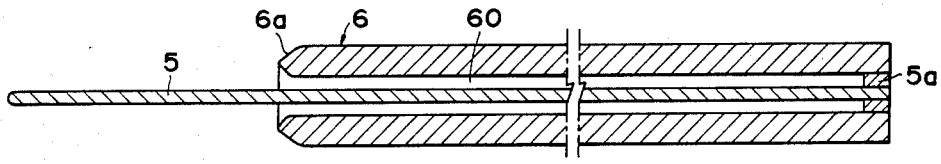
FIG. 3 is a longitudinal sectional view of a needle/-weight structure which is longitudinally slidable, showing the needle fixed at one end of the tubular weight and extending through a central bore of the weight and projecting outwardly beyond the other end of the weight.

The weight member 6 will be explained in detail with reference to FIG. 3 through FIG. 6. The weight member 6 preferably is made of a stainless steel or a desired synthetic resin, has a central through hole 60, and is designed to have a weight of about 1–2 grams to thereby provide an inertia to the needle 5 when the needle is displaced longitudinally. As illustrated in FIG. 3, the needle 5 is connected at one end *5a* thereof to the rear end of the tubular weight 6 and extends through the central through hole 60, and further projects from the front end of the weight member 6. The needle is connected by welding or any other suitable method of connection. Alternatively, the two parts 5 and 6 may be integrally moulded. The connection part, designated at *5a* in FIG. 3, is preferably located at the rearmost position of the longitudinal weight 6 so as to provide suitable resiliency and flexibility to the needle relative to the axis of the tubular weight 6. Preferably, the connection position is selected such that a needle portion projecting from the weight 6 is shorter than a needle portion located between the front end of the weight and the connection position.

Figure 5:
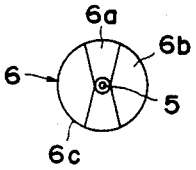
FIG. 5 is a front view of the needle/weight structure shown in FIG. 4.
Figure 4:
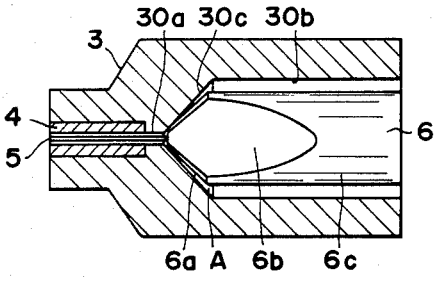
FIG. 4 is an enlarged sectional view of part of a tip holder and a needle/weight structure, showing that the weight member is cylindrical with a conically tapered end and flatly tapered surfaces.
Figure 6:
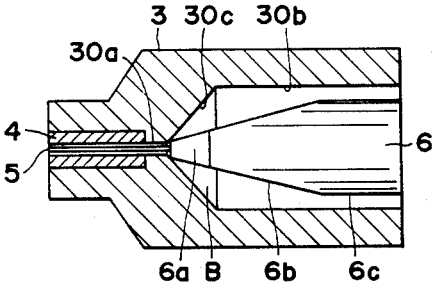
FIG. 6 is an enlarged sectional view of the elements shown in FIG. 4, when viewed at right angles relative to the view of FIG. 4, showing the flatly tapered surfaces.

In FIGS. 4, 5 and 6, the cylindrical weight is conically tapered at its front end and, in addition, has flattened opposed surfaces which extend substantially at right angles with respect to the remaining tapered portions. Thus, there are provided conically tapered surfaces *6a*, which are partially conical and positioned opposite each other relative to the axis of the weight, and planar surfaces *6b* which are also tapered towards the writing tip. The conical surfaces *6a* extend generally at right angles relative to the planar surfaces 6b. Surfaces 6b extend further rearwardly of the body portion 6c of the weight member than do surfaces 6a. Although there are four tapered surfaces 6a and 6b, an arrangement of a single conical surface 6a and a single planar surface 6b may be formed in right angle relation or opposing relation if a desired ink capillary action can be produced at the front end of the weight 6.

The tip holder 3 has a through hole formed by a small front bore 30a, a large bore 30b and an intermediate conical bore 30c which connects the small bore 30a with the large bore 30b. The inclination of inner surface of the tip holder which forms the intermediate conical bore 30c is greater than that of the conical taper of surfaces 6a of the weight 6, relative to an axis of the weight, so that an air space which increases in thickness rearwardly is formed as shown by reference character A in FIG. 4. If desired, the angles of inclination of both the conical bore 30c and conical surfaces 6a may be made substantially identical to each other so that no space is formed or the space A is minimal. The planar portions 6b form an air space B which is larger than the space A.

Figure 7:
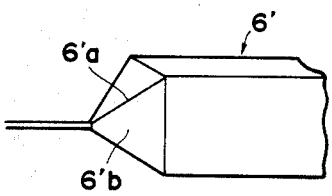
FIG. 7 is a perspective view of a part of a modified structure of the weight member having a rectangular shape in cross section.
Figure 8:
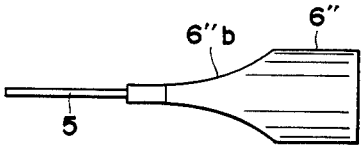
FIG. 8 is a plan view of a part of a weight member according to another embodiment of the invention.

The weight 6 is cylindrical with a circular shape in cross section, but may be polygonal as shown in FIG. 7 or star-shaped (not shown). In rectangular structure shown in FIG. 7, ridges 6'a and sides 6'b correspond to the conical surfaces 6a and planar surfaces 6b, respectively, of the embodiment shown in FIG. 4. Further, the planar portions 6'b can be formed in a curved configuration as illustrated in FIG. 8. Alternatively, with the design of the cylindrical weight being unchanged, the bores 30b and 30c may be designed to be polygonal in cross section.

Figure 9:
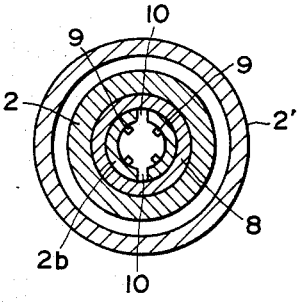
FIG. 9 is a cross sectional view taken along line IX—IX in FIG. 1.

Forward displacement of the needle/weight structure towards the writing tip is limited by abutment of the weight against the conical bore 30c of the tip holder 3. Rearward displacement of same is limited by four lugs 9 projecting radially inwardly and extending longitudinally, as shown in FIGS. 1 and 9.

Figure 10:
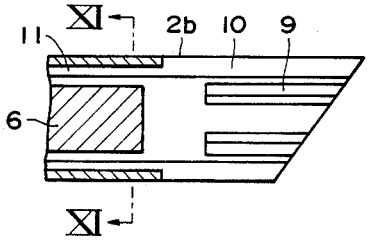
FIG. 10 is a longitudinal sectional view of a modified structure of the casing and the weight member, showing an ink feeding channel formed by a groove and a slit.
Figure 11:
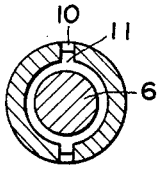
FIG. 11 is a cross sectional view taken along line XI—XI in FIG. 10.
Figure 12:
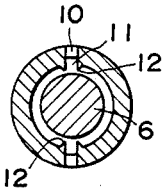
FIG. 12 is view similar to FIG. 11, showing a modified structure of the ink feeding channel.

The abutment portion 2a of the front casing 2 has at its rear portion a connection portion 2b for connection with ink reservoir 8. The four lugs 9 are projections are formed on the inner surface of the connection portion 2b. The connection portion 2b has two slits 10 at opposed positions relative to the axis of the casing, the slits extending in the longitudinal direction. Although only a single lug can function to limit the rearward displacement of the needle/weight structure, a plurality of equally spaced lugs will provide a smooth displacement of the structure without shaking. The slits 10 in the embodiment of FIGS. 1 and 9 may be replaced by grooves or any other form of recesses on the inner surface of the connection portion 2b. Alternatively, slits 10 and grooves 11 may be formed as shown in FIG. 10. In order to facilitate ink flow through a groove 11, the groove can be widened and/or deepened by providing longitudinal protrusions 12 along the edges of the groove 11, as shown in FIG. 12.

The ink passage, formed by slits 10 or by a combination of slits 10 and grooves 11, is preferably extended such that the front end thereof is spaced as much as possible from the lugs 9 so that the ink passage extends beyond the rear end of the weight 6.

The ink feed 7 in the embodiment shown in FIG. 1 is in a press-fit connection at its front end with the tip holder 3. A rear end 2c of the ink feed 7 is also press fit to the abutment 2a of the front casing 2. The press-fit connections prevent ink from leaking out of the ink feed 7 at the connection positions, and also prevent the tip holder from dropping from the casing. Preferably, the engagement force between the ink feed 7 and the abutment 2a of the casing is smaller than the engagement force between the ink feed 7 and the tip holder 3 so that the ink feed may be detached from the abutment 2a and removed from the casing together with the tip holder 3 when the tip holder is pulled from the casing for cleaning the ink feed 7. Accordingly, the ink feed 7 can be pulled from the casing for cleaning without substantial labour, difficulty or soiling of hands. In order to ensure the connection of the holder to the casing, projections or ribs (not shown) which engage with the annular grooves 3a or 3b can be formed on the inner surface of the front casing 2.

Although the present invention has been described with reference to preferred embodiments thereof, many modifications and alterations may be made within the spirit of the invention.

We claim:

1. In a writing instrument comprising a cylindrical casing having therein an ink reservoir, a tubular writing tip, a cylindrical holder for holding said tip, ink feed means disposed between said cylindrical holder and said ink reservoir for feeding ink in said ink reservoir towards said tip, a needle longitudinally slidably positioned within said tip and normally projecting outwardly from one end of said tip and operable to be depressed when writing force is applied to said tip to forcibly retract said needle within said tip, and a weight element connected to said needle for facilitating the longitudinal movement of said needle within said tip, the improvement comprising:

projection means for limiting the displacement of the weight element rearwardly towards said ink reservoir, said projection means comprising at least one projection formed on and extending inwardly from an inner surface of said casing at a position to be abutted by said weight element, said projection extending longitudinally axially of said casing; and channel means for feeding ink in said reservoir towards said ink feed means even when said weight element is in abutment with said projection means, said channel means including at least one slit in said casing adjacent said projection means.

2. A writing instrument according to claim 1, in which said ink feed means comprises a tubular structure having a plurality annular grooves for ink.

3. The writing instrument according to claim 1, wherein said ink feed means is press-fitted at a first end thereof to said cylindrical holder and at a second end thereof to a portion of said casing.

4. The writing instrument according to claim 3, wherein the engagement force between said portion of said casing and said ink feed means is smaller than the engagement force between said cylindrical holder and said ink feed means.

5. In a writing instrument comprising a cylindrical casing having therein an ink reservoir, a tubular writing tip, a cylindrical holder for holding said tip, ink feed means disposed between said cylindrical holder and said ink reservoir for feeding ink in said ink reservoir towards said tip, a needle longitudinally slidably positioned within said tip and normally projecting outwardly from one end of said tip and operable to be depressed when writing force is applied to said tip, and a weight element connected to said needle for facilitating the longitudinal movement of said needle within said tip, the improvement wherein:

said weight element comprises a tubular member extending towards said ink reservoir and having a bore;

said needle is inserted into said bore of said tubular member and projects outwardly from a first end thereof; and said needle is connected to a second end of said tubular member directed toward said reservoir and away from said tip holder.

6. A writing instrument according to claim 5, wherein said second end of said tubular member has a reduced diameter.

7. The writing instrument according to claim 5, wherein said ink feed means is press-fitted at a first end thereof to said cylindrical holder and at a second end thereof to a portion of said casing.

8. In a writing instrument comprising a cylindrical casing having therein an ink reservoir, a tubular writing tip, a cylindrical holder for holding said tip, ink feed means disposed between said cylindrical holder and said ink reservoir for feeding ink in said ink reservoir towards said tip, a needle longitudinally slidably positioned within said tip and normally projecting outwardly from one end of said tip and operable to be depressed when writing force is applied to said tip, and a weight element connected to said needle for facilitating the longitudinal movement of said needle within said tip, the improvement wherein:

said weight element comprises an elongated member having at a first end thereof adjacent said tip and spaced from said ink reservoir, a first tapered portion defining a relatively small space with an inner surface of said cylindrical holder, and a second tapered portion extending generally at right angles relative to said first tapered portion and defining a relatively large space with the inner surface of said cylindrical holder.

9. The writing instrument according to claim 8, wherein said second tapered portion comprises a planar surface.

10. The writing instrument according to claim 8, wherein said second tapered portion is curved.

11. The writing instrument according to claim 8, wherein said ink feed means is press-fitted at a first end thereof to said cylindrical holder and at a second end thereof to a portion of said casing.

* * * * *